United States Patent [19]

Anderson

[11] 4,201,263

[45] May 6, 1980

[54] REFRIGERANT EVAPORATOR

[76] Inventor: James H. Anderson, 2422 S. Queen St., York, Pa. 17402

[21] Appl. No.: 943,711

[22] Filed: Sep. 19, 1978

[51] Int. Cl.[2] ..... F28F 9/22

[52] U.S. Cl. ..... 165/146; 62/527; 165/166

[58] Field of Search ..... 165/146, 147, 133, 185, 165/165, 166; 62/504, 527

[56] References Cited

U.S. PATENT DOCUMENTS

| | | | |
|---|---|---|---|
| 1,200,996 | 10/1916 | Söderlund et al. | 165/146 |
| 2,229,940 | 1/1941 | Spofford | 165/176 |
| 2,670,311 | 2/1954 | Norman et al. | 428/188 |
| 4,139,054 | 2/1979 | Anderson | 165/76 |

FOREIGN PATENT DOCUMENTS

| | | | |
|---|---|---|---|
| 963780 | 5/1957 | Fed. Rep. of Germany | 165/147 |
| 1081991 | 9/1967 | United Kingdom | 165/158 |

*Primary Examiner*—Sheldon Richter
*Attorney, Agent, or Firm*—Kemon & Estabrook

[57] ABSTRACT

An evaporator fabricated from a plurality of plates arranged in spaced parallel relation with one another within a housing or casing having inlet and outlet openings. The plates are arranged to define fluid passages for both water and refrigerant with the refrigerant passages having separators positioned therein. The housing is provided with partitions that cooperate with certain of said plates to define water passages which extend in a serpentine manner from the inlet to the outlet, with the inlet communicating with the greater number of water passages that gradually diminish in number from the inlet to the outlet.

3 Claims, 4 Drawing Figures

REFRIGERATION DIAGRAM FOR R-12

REFRIGERANT EVAPORATOR

BACKGROUND OF THE INVENTION

When a heat exchanger is employed as an evaporator, it is important to keep all surfaces wetted so that a maximum heat transfer effect occurs between the wetted surfaces and the liquid in order to create bubbles or boiling by the vapor action. As is well known in the field or refrigeration, when an evaporator is covered or filled with a liquid which is boiled by having heat applied to it, through the heat exchanger surfaces, then the liquid itself has much higher density, usually, than the vapor which is created by boiling.

The design of a flat plate heat exchanger may very readily be along the general lines of the heat exchangers shown in applicant's copending application Ser. No. 846,318 filed Oct. 28, 1977. In said application, there is disclosed a unique construction for a flat plate exchanger specifically adapted for condensing or boiling fluids in sea thermal power plants. In addition, applicant's prior U.S. Pat. No. 3,312,054 dated Apr. 4, 1967, deals with heat exchangers in conjunction with a sea water power plant.

SUMMARY OF THE INVENTION

The present invention relates to evaporators for boiling refrigerant in order to cool flowing water or other liquids. The innovations, broadly speaking, as described herein are directed to an evaporator using flat plate water heat exchanger surfaces in conjunction with a nucleating surface for promoting boiling on the refrigerant side, thereby increasing the amount of heat transfer per unit of surface used. Another innovation is the idea of using a sinuous path consisting of multiple passes on the water side of the exchanger, in which each successive pass has less area, so that the velocity of the water is increased from the first pass to the last pass. This arrangement compensates for reduced temperature difference as the water flows through the exchanger. Another innovation is the concept for increasing the amount of available surface on the refrigerant side and providing said surface with small holes or the like for promoting nucleation points, and thereby increasing the rate of boiling heat transfer. The foregoing tend to help to improve efficiency of a refrigeration or liquid chilling system or alternatively to reduce the cost per unit of refrigeration produced.

DESCRIPTION OF THE REFERRED EMBODIMENT

Figure 1:
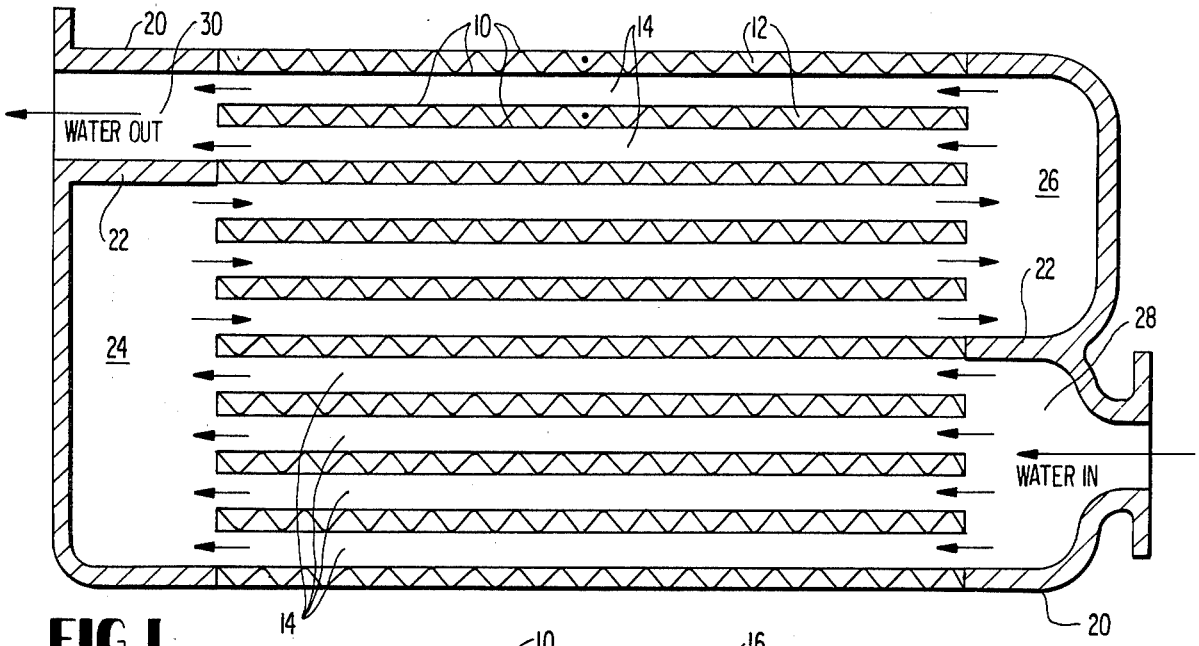
FIG. 1 is a vertical sectional view of a plate type evaporator embodying the present invention.

As shown in FIG. 1, the heat exchanger is an evaporator and consists of a plurality of plate members 10 that are assembled in a stack. The plate members 10 are arranged in pairs so as to define between the plates of each pair passageways 12 while water passages 14 are provided between the plates 10 of each adjacent pair.

The vapor passageways 12 as defined by adjacent heat transfer plate members 10 are provided with a nucleating surface in order to increase the rate of heat transfer on the boiling fluid. It has been determined that by placing suitable material in the boiling liquid in the passageways 12 and wherein said material is provided with very small holes and/or numerous small passages, that these act as nucleation sites which promote more rapid boiling.

Figure 2:
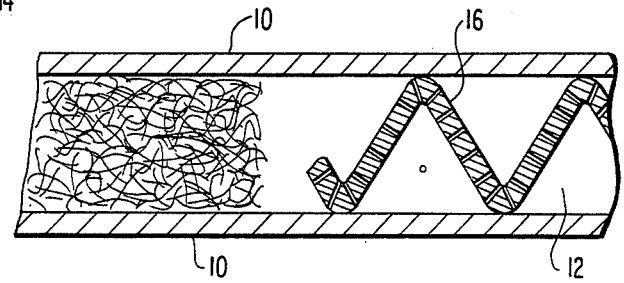
FIG. 2 is a detailed sectional view of a pair of transfer plates of the evaporator of FIG. 1.

There are several possible ways to provide nucleation sites in a surface, and there is shown in the right-hand portion of FIG. 2 a sheet of perforated metal 16 that is corrugated to fill the space in the passageway 12. The perforated metal sheet 16 may be formed with small round holes or the holes may be of various other shapes, or in lieu of holes, the sheet of corrugated metal can be merely slotted and the space between said slots pressed into a corrugated shape. In addition, there are many well known ways to perforate metal and any piece of perforated metal can be bent into various shapes and provided with holes of varying sizes that could be suitable for nucleation sites. A still further way of providing a nucleation site is to use woven wire screen that has been corrugated to fill the space or passageways 12. Another possibility for providing good heat transfer and many nucleation sites would be through the use of foamed metal 18 as illustrated in the left-hand portion of FIG. 2. This foamed metal 18 could very readily be aluminum or copper that is expanded to take the form of a sponge which has many holes through it and likewise provides for many nucleation sites. The foregoing are merely a few illustrations of different types of material that may be placed in the passageways 12 and which will act as nucleation sites with respect to the boiling liquid moving through said passageways.

As shown in FIG. 1, the evaporator includes a housing or casing 20 within which the plate members 10 are arranged in pairs so as to define the passageways 12 and the water passages 14. The housing 20 is formed with inwardly projecting partitions or abutments 22 that engage certain of the plate members 10 so as to define headers 24 and 26. In addition the partitions 22 in conjunction with the casing 20 define an inlet 28 and an outlet 30 for the water flowing through the water passages 14.

The partitions 22 engage certain of the plate members 10 in such a manner as to form the evaporator into a three-pass exchanger wherein the water flows through the inlet 28 and through the water passages 14 from the righthand side at the bottom of the evaporator, as shown in FIG. 1, toward the header 24 at the left-hand side of the evaporator. From the header 24 the water flows through the next series of passages 14 to the header 26 from where it flows to the outlet 30 in the upper series of water passages. Thus the water in moving from the inlet 28 to the outlet 30 follows a serpentine path while moving over the surfaces of the plate members 10. It is to be noted that the lower or initial series of water passages 14, as shown in FIG. 1, are four in number with the second or middle series having three passages for the water with the upper series having only two water passages.

The foregoing is by way of illustration only as the evaporator could be formed with other combinations of water passages as long as the path of flow was decreasing in passage number.

The purpose of successively varying the number of passages through which the water moves is to increase the velocity of the water as it moves through each set of water passages. This arrangement has a specific advantage in that it increases the velocity in the passages in which the water has been warmed to a higher temperature, and thereby counteracts the temperature difference by increasing the heat transfer coefficient in these higher velocity passages. During the time that water is moving from the inlet 28 to the outlet 30, a refrigerant of any suitable type, such as from the halocarbon family, will be moving through the passageways 12 between the plate members 10 where it will engage the material positioned within said passageways 12 which act as nucleation sites for the boiling liquid.

Figure 3:
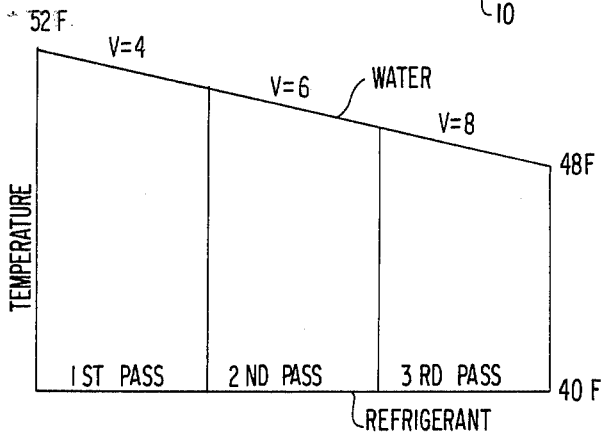
FIG. 3 is a diagram showing the temperature of the water and the boiling fluid as the water successively passes through each set of passages in the evaporator.

The foregoing effect is shown a little more clearly in FIG. 3 where the diagram shows the temperature of the water and the boiling fluid as the water successively passes through each set passage 14 in moving from the inlet 28 to the outlet 30. As illustrated in FIG. 3, the refrigerant, which is boiling at practically constant pressure, stays at a constant temperature of 40° F. throughout the exchanger. On the other hand, the water, as it is cooled by the boiling refrigerant and as it flows through the exchanger or evaporator, is gradually cooled from the initial temperature of 52° F. to the leaving temperature of 48° F . This means that the temperature difference between the water and the refrigerant during the initial passage of the water in the water passages 14 is greater than it is in the succeeding passages of the water moving through the evaporator. Therefore, if the heat transfer coefficients were the same in each of the passes, then less heat transfer would occur in the last pass than in the first pass. It is desirable, however, to have the amount of liquid boiled nearly the same in each of the passages; therefore, the heat flow should be about the same in each passage. By increasing the velocity as the water flows through the exchanger or evaporator, the heat transfer coefficient is increased at increased water velocity.

If the velocity of the water in the passages 14 is in the initial or first pass lower than in the middle or second pass, and is then higher in the final or third pass than in the second pass, then the heat transfer coefficient is successively higher in each pass. If the coefficient is higher then quantity of heat transferred per unit area can be the same, if coefficient is U ($1/\Delta T$). The rate of heat transfer per unit area or $Q/A = U \times \Delta T$, and this is constant if $U \times \Delta T$ is constant. Since $\Delta T$ which is the temperature difference between the water and the refrigerant must, by its very nature, decrease, then we can obtain the same value of Q/A by increasing U as $\Delta T$ increases. This is illustrated by the following where U is successively increased as temperature differences decrease:

$$Q/A = U\Delta T = \text{constant if } U\,\Delta T \text{ is constant}$$

$$Q/A - U_1\Delta T_1 = U_2\Delta T_2 = U_3\Delta T_3$$

If $U_1 = 600$, then $$Q/A = 6798 = 600(51.33 - 40) = 679.8(50 - 40) = 784 \quad (48.7 - 40)$$

This causes the heat transfer rate to the boiling passages to remain more nearly constant than it would otherwise be with constant water velocity through the whole exchanger or evaporator.

Since pressure loss of water being pumped, through the exchanger or evaporator, is also an important factor in the economics of cooling water, then by this means we have higher water velocities only in the last part of the exchanger or evaporator. The water velocities are lower in the initial passes of the exchanger, thereby decreasing the average required velocity of water in the exchanger, and improving the economics by reducing the amount of pressure drop or pumping power required for a given amount of heat transfer.

Figure 4:
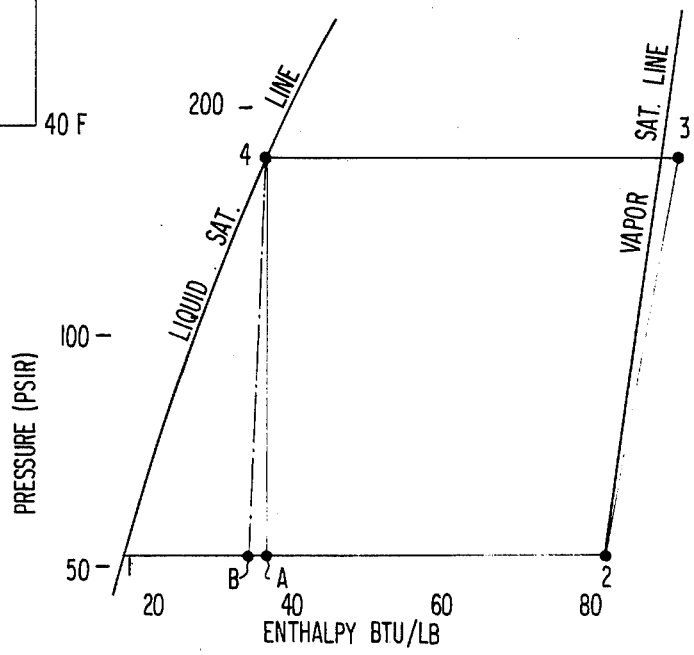
FIG. 4 shows a pressure entropy diagram for a common refrigerant of the halocarbon family designated R-12.

There is shown in FIG. 4 a pressure entropy diagram for a common refrigerant of the halocarbon family, designated R-12 . The ordinary refrigeration cycle corresponding to cooling refrigerant to 20° and compressing it to a condensing temperature of 120° is shown in FIG. 4. Starting at point 4, the liquid refrigerant leaves the condensor and expands through a throttle valve at constant enthalpy to point A at the lower pressure of approximately 51 psia. As the refrigerant expands, part of it flashes into vapor and enters the evaporator where heat from flowing water or other liquid boils the vapor to move from point A to point 2 on the diagram where it is completely boiled. From point 2 to point 3 the vapor is compressed at constant enthalpy in a compression cycle to the high pressure of 172 psia at point 3. From this point it flows through the condenser where the heat of vaporization is removed and it is changed to a liquid at point 4 on the diagram. This is a conventional theoretical vapor compression refrigeration cycle which is commonly used for air conditioning purposes in water chilling systems. The actual operating cycle is somewhat less efficient than the theoretical cycle shown, partly because of pressure drop losses and partly because the compressor does not compress the vapor isentropically as shown on the diagram, but more power is used in compression. This concept is known in air conditioning and refrigeration circles.

Thus, the evaporator or heat exchanger as shown in FIG. 1, is directed to the concept of using flat plate heat exchanger surfaces in order to cool flowing water or other liquid by a boiling refrigerant. The flat plate surfaces in defining passageways for the refrigerant are also provided with various types of material to create nucleating surfaces which promote the boiling of the refrigerant within said passageways. In addition, the evaporator or heat exchanger in being formed as a multipass exchanger for the passage of water therethrough causes an increase in the velocity in the water as it successively passes through each set of passages resulting in an increase in the velocity in the passages in which the water has been warmed to a higher temperature by the boiling refrigerant and thereby counteracts the temperature differences by increasing the heat transfer coefficient and the higher velocity passages.

Although the foregoing description is necessarily of a detailed character, in order that the invention may be completely set forth, it is to be understood that the specific terminology is not intended to be restrictive or confining, and that various rearrangements of parts and modifications of detail may be resorted to without departing from the scope or spirit of the invention as herein claimed.

I claim:

1. An evaporator comprising a casing having a plurality of plates arranged in pairs in vertical planes and in spaced parallel relation to one another, each pair of plates defining a passageway and each pair of plates defining a passage between adjacent pairs of plates for the passage of water, a refrigerant consisting of a boiling fluid at a constant temperature flowing through said passageways in a crossflow path to said passages, said casing having inlet and outlet water openings therein defined by internal abutments, said abutments engaging certain of said plates and forming a sinuous path for the water moving through said passages from said inlet to said outlet with the initial series of water passages being greater in number than the next series which is in turn greater in number than the next series that communicates with the outlet opening.

2. An evaporator as defined in claim 1 wherein said passageways are filled with corrugated perforated metal to define nucleating sites to promote the boiling of the refrigerant to increase the amount of heat transfer.

3. An evaporator as defined in claim 2 wherein said sinuous path consists of said water passages with the number of water passages decreasing from the inlet to the outlet to increase the velocity of the water as it moves through said sinuous path.

* * * * *